United States Patent [19]

Esposito et al.

[11] Patent Number: 4,936,354

[45] Date of Patent: Jun. 26, 1990

[54] BACKING PLATE ARRANGEMENT FOR FLEXIBLE GRIPPER TAPE

[75] Inventors: Giancarlo Esposito, Florence; Luciano Cinel, San Vito di Leguzzano, Italy

[73] Assignee: Nuovopignone -Industrie Meccaniche e Fonderia S.p.A., Italy

[21] Appl. No.: 352,827

[22] Filed: May 16, 1989

[30] Foreign Application Priority Data

May 27, 1988 [IT] Italy ..... 20764 A/88

[51] Int. Cl.[5] ..... D03D 47/18

[52] U.S. Cl. ..... 139/449

[58] Field of Search ..... 139/449

[56] References Cited

U.S. PATENT DOCUMENTS 3,175,587 3/1965 Gove et al. ..... 139/449

FOREIGN PATENT DOCUMENTS 2001965 10/1969 France ..... 139/449

*Primary Examiner*—Andrew M. Falik

[57] ABSTRACT

An operating system for the flexible gripper tapes in shuttleless looms in which the backing plate that limits upward motion of the tape is located in the region where the unwound tape is not engaged by the drive wheel, and which plate is provided with suitably disposed holes fed with compress air. The compressed air guides the tape and helps prevent undesirable buckling.

3 Claims, 2 Drawing Sheets

BACKING PLATE ARRANGEMENT FOR FLEXIBLE GRIPPER TAPE

This invention relates to an improved system which results in more efficient, rational, rapid and economical operation of the flexible gripper tapes in shuttleless looms.

In shuttleless looms, the weft yarns are inserted into the shed in known manner by two grippers mounted at one end of two perforated or non-perforated flexible tapes which are each driven with reciprocating motion by a toothed on smooth drive wheel, respectively. These tapes are guided horizontally, so as not to buckle by a guide plate which is fixed to the loom in the region where the tape no longer engages the drive wheel, which plate arts as a backing plate to prevent any buckling of the tape due to tape deformation and centrifugal action.

Among the drawbacks inherent in this well-known technique is that considerable friction is produced by the tape as it directly slides along and contacts the plate. This results not only in rapid tape wear and increased energy and operating costs, but also in the production of much heat which negatively affects the operating conditions of the tape, this being currently formed of composite resin and carbon fibre material which is very temperature-sensitive.

In certain cases an attempt has been made to overome these problems by using a teflon stick inserted into a suitable slot in said guide plate in order to lubricate the tape, but in general this and all other known operating systems for such flexible tapes are satisfactory only at limited loom operation speeds. In this respect at the high speeds employed of the order of 600 beats per minute in modern looms which operate at speeds on the order of 600 cycles per minute, the centrifugal force of the tape, which as is well known increases with the square of the speed, develops a degree of friction which results in rapid overheating and thus considerable and very premature wear of the tape. The object of the present invention is to obviate this drawback by providing a flexible tape operating system which enables the use of the high operating speeds required by modern looms to be achieved without danger or damage to the flexible tape.

This is attained by creating in practice a pneumostatic effect between the tape and horizontal guide plate to counteract the centrifugal action and elastic buckling deformation of the tape.

Thus, because direct rubbing contact between the tape and guide plate surface is avoided, friction between their respective surfaces is very much reduced limiting tape wear, considerably increasing tape operating life, reducing the needed operating force, making it possible to use lighter mechanisms with beneficial effects on cost and weight. Again the reduced heat development improves the tape operating conditions.

Thus, the operating system for flexible gripper tapes in shuttleless looms which is an object of the present invention, comprises a toothed or non-toothed drive wheel that reciprocably rotates to drive the flexible tape, and a backing plate for horizontally guiding the tape in the region in which this tape no longer engages the drive wheel, this plate being rigid with the fixed loom structure. A particular feature of the present invention is that the backing plate is provided with holes through which compressed air passes thereby creating an air cushion between the plate and tape that prevents undersirable flexing or buckling of the tape.

Again, to reduce the required air quantity to a minimum and improve system performance, the holes are sized to diameters of the order of one tenth of a millimeter, and are provided on both sides of the plate approximately midway between the longitudinal tape edges and the longitudinal tape axis.

According to one modification of the invention, instead of using specifically sized small holes, large holes are used which are filled with a porous sintered metal plug which serves the same function as the sized small holes.

The invention is described hereinafter with reference to the accompanying drawings which illustrate a preferred embodiment thereof given by way of non-limiting example only, as technical or constructional modifications can be made thereto but without leaving the scope of the inventive idea. For example, instead of using a toothed drive wheel and consequently a perforated tape, a non-perforated tape can be used passing about a smooth-faced drive wheel.

Figure 1:
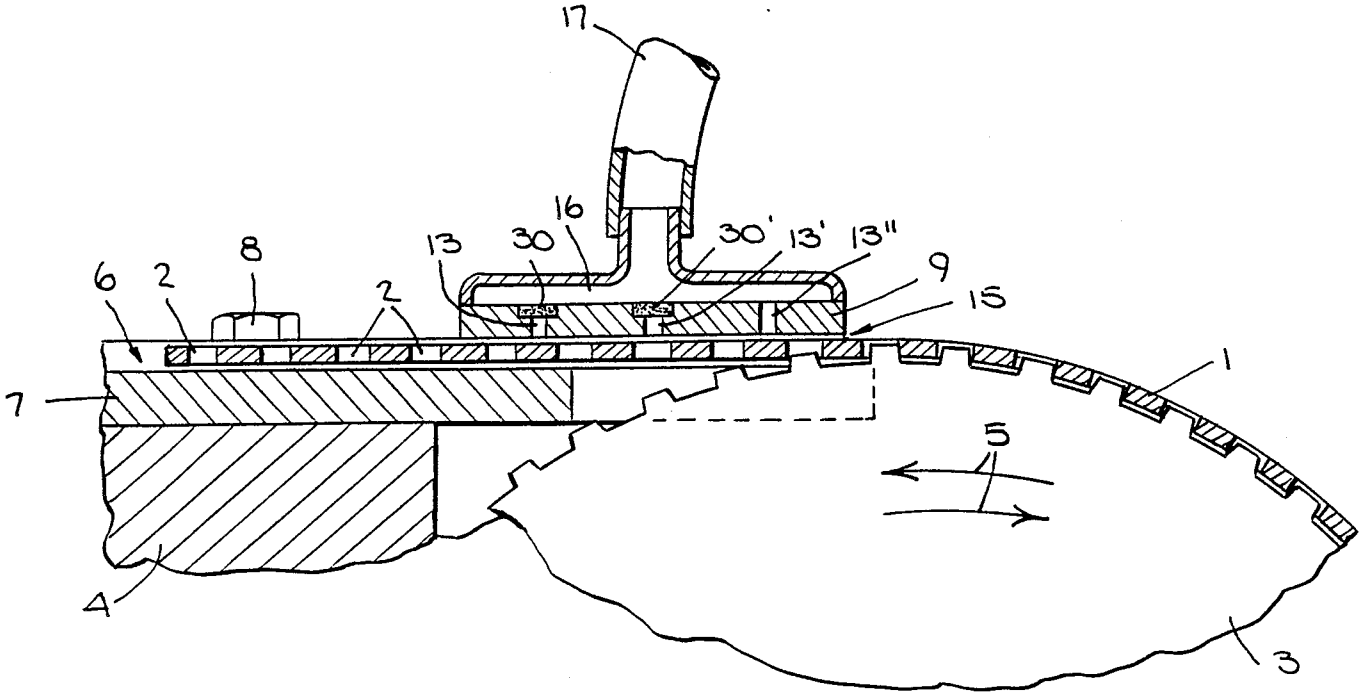
FIG. 1 is a side cross-sectional view through the flexible tape operating device of the invention.

In the figures, the reference numeral 1 indicates a perforated flexible gripper tape for a shuttleless loom perforations 2 of the gripper tape 1 engage a toothed drive wheel 3 which is rotatably supported by the loom rigid structure 4 and is rotated with reciprocating movement in the direction of the arrows 5 (see specifically FIG. 1).

Figure 2:
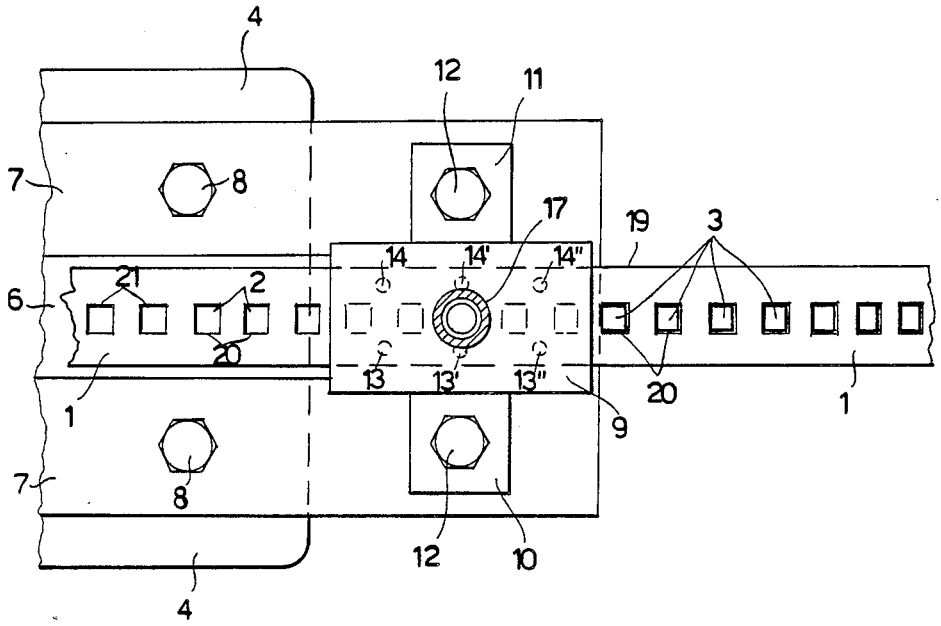
FIG. 2 is a plan view of the operating device of FIG. 1.

During its reciprocating travel, tape 1 slides in a longitudinal groove 6 provided in a lower guide 7 which is fixed by bolts 8 to the loom rigid structure 4. In order to counteract the centrifugal action of the tape and its elastic reaction to the deformation imposed by the drive wheel 3, both of which cause the tape to buckle and press upward, in the area in which tape 1 becomes disengaged from the toothed drive wheel 3, there is provided a backing plate 9 for horizontally guiding the tape. This plate is provided with two side flanges 10 and 11 which are fixed by bolts 12 to the lower guide 7, and with two rows of vertical sized holes 13, 13', 13'' and 14, 14', 14'', which connect the interspace 15 between the tape 1 and lower surface of the plate 9 to a common pressure chamber 16 fed with compressed air through the tube 17. The two rows of holes 13 and 14 are made up of either sized small holes having diameters of the order of one tenth of a millimeter or larger holes filled with porous sintered metal plugs 22 (See FIG. 1). These plugs 30 and 30' can either be placed inside the bore of a hole which allows common pressure chamber 16 to communicate with flexible tape 1, or can be placed in a countersunk space adjacent to and in communication with the hole which leads to tape 1. The sintered plugs 30 serve the same purpose as do the small 0.1 mm holes, namely, to limit air flow to the tape. The two rows of holes are provided in the plate 9 along the two lines midway between the longitudinal edges 18 and 19 respectively of the tape 1 (see FIG. 2) and the longitudinal edges 20 and 21 respectively of the perforations 2 in said tape. By supplying compressed air to the common pressure chamber 16, only a modest amount of pressure will be needed to produce an air cushion in interspace 15 which will guide tape 1 while keeping tape 1 from contacting plate 9.

We claim:

1. An operating system for use in shuttleless looms having a fixed loom structure and at least one flexible gripper tape driven by a drive wheel which can be reciprocatingly rotated to reciprocably drive the flexible gripper tape, the tape unwinding off the drive wheel past a region in which it is no longer engaged by the drive wheel, the tape as it passes through this region being horizontally disposed, the improvement comprising:

a backing plate for horizontally guiding the flexible gripper tape in the region in which it is not engaged by the drive wheel, the backing plate being rigidly affixed to the fixed loom structure above the tape, the backing plate having a plurality of holes connected to means for supplying compressed air, the plate having a relatively flat lower surface proximate to the tape, the holes communicating with the flat lower surface so that when compressed air passes outward through the holes an air cushion is created between the plate and the flexible gripper tape.

2. An operating system as in claim 1 wherein the holes are approximately one tenth of a millimeter in diameter, and are disposed in the plate along a pair of lines parallel to the longitudinal tape edges and the longitudinal tape center axis.

3. An operating system as in claim 1, further comprising a plurality of porous sintered metal plugs corresponding in number to the plurality of holes, one plug being disposed adjacent to and in communication with each of the holes.

* * * * *